US005257073A

United States Patent [19]

Gross et al.

[11] Patent Number: 5,257,073

[45] Date of Patent: Oct. 26, 1993

[54] CORONA GENERATING DEVICE

[75] Inventors: Robert A. Gross, Penfield; Raymond E. Bailey, Webster, both of N.Y.; Joseph H. Lang, Stamford, Conn.

[73] Assignee: Xerox Corporation, Stamford, Conn.

[21] Appl. No.: 907,082

[22] Filed: Jul. 1, 1992

[51] Int. Cl.[5] ..... G03G 15/02

[52] U.S. Cl. ..... 355/221; 250/324; 361/213; 361/229; 430/902

[58] Field of Search ..... 355/221, 214; 361/230, 361/225, 212, 213, 217, 229; 250/324–326; 430/937, 902

[56] References Cited

U.S. PATENT DOCUMENTS

| | | | |
|---|---|---|---|
| 2,836,725 | 5/1958 | Vyverberg | 250/49.5 |
| 4,086,650 | 4/1978 | Davis et al. | 361/229 |
| 4,265,990 | 5/1981 | Stolka et al. | 430/59 |
| 4,449,808 | 5/1984 | Abreu | 361/229 X |
| 4,456,370 | 6/1984 | Hayes, Jr. | 355/214 X |
| 4,585,320 | 4/1986 | Altavela et al. | 355/221 X |
| 4,585,322 | 4/1986 | Reale | 355/221 X |
| 4,585,323 | 4/1986 | Ewing et al. | 355/221 X |
| 4,646,196 | 2/1987 | Reale | 361/230 |
| 4,792,680 | 12/1988 | Lang et al. | 250/325 |
| 4,841,409 | 6/1989 | Kalwar | 250/324 X |
| 4,920,266 | 4/1990 | Reale | 250/324 |

OTHER PUBLICATIONS

Research Disclosure Journal, Item No. 19957 "Corona Discharge Unit", Nov. 1980, p. 508.

*Primary Examiner*—A. T. Grimley
*Assistant Examiner*—Shuk Y. Lee
*Attorney, Agent, or Firm*—Denis A. Robitaille

[57] ABSTRACT

A corona generating device of the type in which a control screen adjacent a corona generating electrode regulates the charge flow. The control screen is coated with a substantially continuous layer of boron electroless nickel.

26 Claims, 2 Drawing Sheets

CORONA GENERATING DEVICE

The present invention relates generally to electrostatographic printing machines and, in particular, to corona generating devices which produce a charged corona.

In an electrostatographic reproducing apparatus commonly used today, a photoconductive member may be charged to a negative potential and thereafter exposed to a light image of an original document to be reproduced. The exposure step discharges the surface of the photoconductive member in background areas to create an electrostatic latent image on the member corresponding to the image areas contained within the original document. Thereafter, the electrostatic latent image on the photoconductive insulating member is developed into a visible image by developing the latent image with a developing material of carrier granules and toner particles. During development, the toner particles are attracted from the carrier granules by the charge pattern of the latent image on the photoconductive member to form a toner powder image on the photoconductive surface. This powder image may be subsequently transferred to a support surface, such as copy paper or the like, to which it may be fused to form a permanently affixed image thereon. Following transfer of the toner image to the support surface, the surface of the photoconductive member may be discharged and cleaned of residual toner to prepare it for the next imaging cycle.

Various types of charging devices have been used to charge or precharge the surface of a photoconductive member. In commercial use, for example, corona generating devices exist wherein a voltage of 2,000 to 10,000 volts may be applied across an electrode to produce a corona spray which imparts electrostatic charge to the surface of the photoconductive member.

One particular corona generating device includes a single corona generating electrode wire extended between a pair of insulating end blocks mounted on either end of a channel formed by a shield or pair of shield members. Another device, frequently used to provide more uniform charging and to prevent overcharging, includes two or more corona generating electrode wires with a control grid or screen, having a plurality of parallel wires or apertures in a plate, which is positioned between the corona generating electrode wires and the photoconductive member. A potential having the same polarity as that applied to the corona generating electrodes but having a much smaller voltage magnitude, usually on the order of several hundred volts, is applied to the control grid which suppresses the electric field between the control grid and the corona wires and markedly reduces the ion current flow to the photoconductive member.

Yet another type of corona charging device is described in U.S. Pat. No. 4,086,650 to Davis et al. As described therein, the corona discharge electrode is coated with a relatively thick dielectric material such as glass to substantially prevent the flow of conduction current therethrough. Thus, the delivery of charge to the photoconductive surface is accomplished by a displacement current or capacitive coupling through the dielectric material. This type of corona charging device has the advantage of providing a uniform charge to the surface of a photoreconductive member with a relatively low maintenance charging device.

In addition to providing a negative charge, it is often desirable to provide a negative precharge prior to providing a positive charge on the photoconductive member. Negative precharging is used to neutralize the positive charge remaining on the photoreconductive member after transfer of the developed toner image to the copy sheet and to clean the photoreconductive member in preparation for the next copying cycle. Such a precharge corona generator typically operates at an AC potential of between 4,500 and 6,000 volts rms and at a frequency between 400 to 600 Hz. A typical corona discharge device of this type is shown generally in U.S. Pat. No. 2,836,725 in which a conductive corona electrode in the form of an elongated wire is connected to a corona generating AC voltage source.

Certain difficulties have been observed when using corona generating charge devices. A primary problem exists in that various nitrogen oxide species are produced by the corona. These nitrogen oxide species are adsorbed by solid surfaces. In particular, it has been observed that these nitrogen oxide species are adsorbed by the conductive control grid, the shield, shield members and other components of the corona generating device. The adsorption of nitrogen oxide species occurs despite the fact that the corona generating device may be provided with a directed air flow during operation for removing the nitrogen oxide species as well as controlling ozone emissions. In fact, during the process of collecting ozone, directed air flow may exacerbate problems by carrying the nitrogen oxide species to an affected area of the charging device or even to some other machine part.

The reaction of corona generating process byproducts, such as nitrogen oxide, with the screen or other corona generating device components can result in corrosive buildup and deposition on the surfaces thereof. These deposits can cause problems such as reducing the screen open area, causing non-uniform photoreceptor charging manifested as side to side density variations or dark and light streaks in the output copy. Also, depending on environmental conditions, deposits may charge up and effectively increase the shield or screen voltage, resulting in similar uniformity defects. Extreme cases of corrosion can also lead to arcing between the corona generating electrode and the screen on the shield members.

It has also been found that adsorption can be a physically reversible process such that the adsorbed nitrogen oxide species are gradually desorbed when a machine is turned off for an extended period of idleness. It should be understood that the adsorbed and desorbed species are both nitrogenous but not necessarily the same, i.e., there may be conversion of $NO_2$ to $HNO_3$. When the operation of the machine is resumed, a copy quality defect, commonly called a parking deletion, is observed wherein a line image deletion or lower density image is formed across the width of the photoreceptor at that portion of its surface which was opposite the corona generating device during the period of idleness. It is believed that the nitrogen oxide species in some way interact with the surface of the photoreceptor to increase the lateral conductivity thereof, such that the photoreceptor cannot retain a charge in image configuration. This phenomenon basically causes narrow line images to blur or to wash out so as to not be developed as a toner image.

Parking deletion defects have been observed with photoreceptors which generally have a conductive drum substrate having a thin layer of selenium or an alloy thereof deposited on its surface to provide the imaging surface. This deletion problem has also been known to occur with other photoreceptor configurations such as plates, flexible belts, and the like, as well as other photoreceptor materials which may include one or more photoconductive layers on a supporting substrate. The supporting substrate may be conductive or may be coated with a conductive layer over which photoconductive layers may be coated. Alternatively, the multilayered electroconductive imaging photoreceptor may comprise at least two electrically operative layers, a photogenerating layer or a charge generating layer and a charge transport layer which are typically applied to the conductive layer. For further details of such a layer, attention is directed to U.S. Pat. No. 4,265,990. In these varying structures, several of the layers may be applied with a vacuum deposition technique where very thin layers are desirable.

It has been observed that even after a relatively short period of operation, i.e. 15 minutes, and a period of idleness of, say, several hours, a mild line defect and a coincident image deletion may be realized. Furthermore, prolonged exposure of the photoreceptor to the desorbing nitrogen oxide species during extended periods of idleness increases the severity of the line defect or results in increased line spreading. Thus, for example, the effects of parking deletion may be seen after a machine has been operated for about 10,000 copies, inactive overnight, and then activated.

During the initial stage of exposure of the photoreceptor to the desorbing nitrogen oxide species, reaction between the photoreceptor and the nitrogen oxide species is purely at the surface of the photoreceptor. Thus, it is possible to rejuvenate the photoreceptor by washing the surface thereof with alcohol. However, after a prolonged period of time the reaction tends to penetrate the photoreceptor surface layer such that the defect cannot be resolved simply by washing with a solvent. As indicated above, the defect is reversible to some degree by a rest period. However, the period involved may be on the order of several days, which may be objectionable to an operator.

In corona generating devices, it has been found that the material from which the components, such as the shield or screen, is fabricated or coated has a significant effect on the severity of parking deletions. In the prior art, stainless steel materials have commonly been used. Other materials, such as corrosion resistant ferris materials which prevent the rapid oxidation of the component material and the concurrent loss of performance of the corona generator, have met with limited success, primarily due to the corrosive effect of the negative corona produced by the device.

In other attempts to reduce the deletion problem associated with corona charging, considerable work has been done to reduce the adsorption of nitrogen oxides species by the stainless steel components via the application of electrodag coatings to the surfaces thereof. Such coatings typically include a reactive metal base such as nickel, lead, copper, zinc or mixtures thereof. These reactive metal base materials tend to absorb or form harmless compounds with the nitrogen oxide species. Electrodag materials have also had limited success in addressing the problem of parking deletions. However, parking deletion problems have continued due to the failure of the electrodag materials to continue to absorb or form harmless compounds with the nitrogen oxide species over time. In addition, certain components are somewhat expensive to fabricate In particular, fabrication of the stainless steel control screen generally requires an inherently expensive photoetching or chemical milling processes to achieve the desired mechanical tolerances. Alternatively, high quality stamping is useful, and less expensive, but has a shortcoming in that the required flatness for the screen often cannot be achieved. A screen fabricated from a beryllium copper material with an electrolytic dull nickel plating has also been successfully used in the Xerox model 1065. Although this material has met performance requirements, the selection of the material has been determined to be overly expensive and not cost effective.

Accordingly, it is desirable to provide an improved and economical corona generating device for depositing a charge on an imaging surface wherein damaging nitrogen oxide species, generated by the corona generating device, adsorbed by components thereof and desorbed when the device is inactivated, are neutralized. The following disclosures appear to be relevant:

Research Disclosure Journal, Item No. 19957; "Corona Discharge Unit"; November 1980, p. 508

U.S. Pat. No. 4,585,320; Patentee: Altavela, et al.; Issued: Apr. 29, 1986

U.S. Pat. No. 4,585,322; Patentee: Reale; Issued: Apr. 29, 1986

U.S. Pat. No. 4,585,323; Patentee: Ewing et al.; Issued: Apr. 29, 1986

U.S. Pat. No. 4,646,196; Patentee: Reale; Issued: Feb. 24, 1987

U.S. Pat. No. 4,792,680; Patentee: Lang, et al.; Issued: Dec. 20, 1988

U.S. Pat. No. 4,920,266; Patentee: Reale; Issued: Apr. 24, 1990

The relevant portions of the foregoing disclosures may be briefly summarized as follows:

Item No. 19957 in the Research Disclosure Journal of November 1980 at page 508 describes an electrophotographic copying machine having corona charging unit wherein the ions generated from the corona discharge can interact with the photoconductive member and the conductive housing to form salts, e.g. nitrates which during an overnight period of rest may have a detrimental effect on the part of the stationary photoconductive member opposite the opening to the corona charging unit. This detrimental effect is claimed to be overcome by coating the inner side of the housing with a cellulose acetate butyrate copolymer in which carbon black particles have been dispersed.

U.S. Pat. No. 4,585,320 to Altavela et al. addresses the same problem addressed herein and provides a solution by means of plating the corotron elements capable of adsorbing nitrogen oxide species with a thin layer of lead.

U.S. Pat. No. 4,585,323 to Ewing et al. addresses the problem addressed herein and teaches a remedy by providing a continuous thin layer of a paint containing a reactive metal such as nickel, lead, copper, silver or zinc on the surfaces which adsorbed the nitrogen oxide species.

U.S. Pat. No. 4,585,322 also addresses the problem addressed herein and provides an alkali metal silicate coating on the elements capable of adsorbing and neutralizing the nitrogen oxide species.

U.S. Pat. No. 4,585,323 to Ewing et al. addresses the problem addressed herein and teaches a remedy by providing a continuous thin layer of a paint containing a reactive metal such as nickel, lead, copper, silver and zinc on the surfaces which adsorbed the nitrogen oxide species.

U.S. Pat. No. 4,646,196 also addresses the problem addressed herein and provides a conductive dry film of aluminum hydroxide which may contain conductive particles such as graphite as a coating on the elements capable of absorbing and neutralizing the nitrogen oxide species. Electrodag 121 is disclosed as a coating.

U.S. Pat. No. 4,792,680 also addresses the problems associated with parking deletions and provides a corona device having a beryllium copper screen capable of absorbing and neutralizing the nitrogen oxide species.

U.S. Pat. No. 4,920,266 also addresses the problems addressed herein and provides a corona generating device having elements susceptible to nitrogen oxide species being coated with a substantially continuous thin film of aluminumhydroxide containing graphite and powdered nickel.

While the coatings described in the above U.S. patents are capable, to varying degrees, of performing satisfactorily in certain applications, certain difficulties have been experienced. Most generally, the coatings effective in neutralizing corona effects have been the alkali metal silicate, particularly potassium silicate with graphite suspended in aqueous media as described in U.S. Pat. No. 4,585,322 and the aluminum hydroxide also with suspended graphite as described in U.S. Pat. No. 4,646,196. In particular, while the alkali metal silicate coatings, as used as a coating on the conductive control grid, may be characterized as exhibiting long life in neutralizing the corona effects which lead to copy quality degradation, they suffer from the difficulty that insulating particles tend to form on the grid, particularly at relatively low relative humidity.

In a particular example, after about 8 hours of use, a white powder, presumably an alkali metal nitrate or carbonate is collected on the corona generating device components. The white powder on the control grid alters the electrostatic relationship in the charging device in that the current delivered to the control grid from the corona electrodes and the resultant current delivered to the photoreceptor varies uncontrollably, thereby providing an unpredictable, uneven charge on the photoreceptor, resulting in poor copy quality. The exact mechanism by which this happens is believed to result from a combination of the apertures of the control screen becoming clogged with the white powder, the resistive nature of the coating, and the particulate nature of the nitrate powder. In particular, the ratio of the current to the control grid to the photoreceptor is determined generally by the geometry of the control grid such that, if the apertures become plugged, that geometry and the ratio between the current to the grid and to the photoreceptor is altered. The resistive nature of the nitrate and carbonate powder causes a change in the effective bias on the grid by an amount equal to the voltage drop across the resistive powder layer. Finally, the particulate nature of the white powder is believed to cause non-uniform electrical fields which, in general, tend to increase the current from the corona generating electrode.

By contrast, while the aluminum hydroxide suspensions described in U.S. Pat. No. 4,646,196 do not form contaminating insulating nitrate and carbonate salts on the corona generating device components, they are limited by an effluent neutralization life of only one tenth that of a potassium silicate based system. Moreover, as previously discussed, the materials and coatings disclosed in the art have significant cost disadvantages, attributing to as much as 60% of the entire cost of a control screen, for example, in some cases.

In accordance with the present invention a corona generating device for depositing a charge on an imaging surface is provided wherein damaging effects of nitrogen oxide species generated by the corona generating process are neutralized by plating with a substantially continuous film of boron electroless nickel.

In a further aspect of the invention, an electrostatographic printing machine including a corona generating device is disclosed, wherein the corona generating device includes components plated with a substantially continuous film of boron electroless nickel.

For a better understanding of the invention as well as other aspects and further features thereof, reference is made to the following description and drawings, in which.

Figure 1:
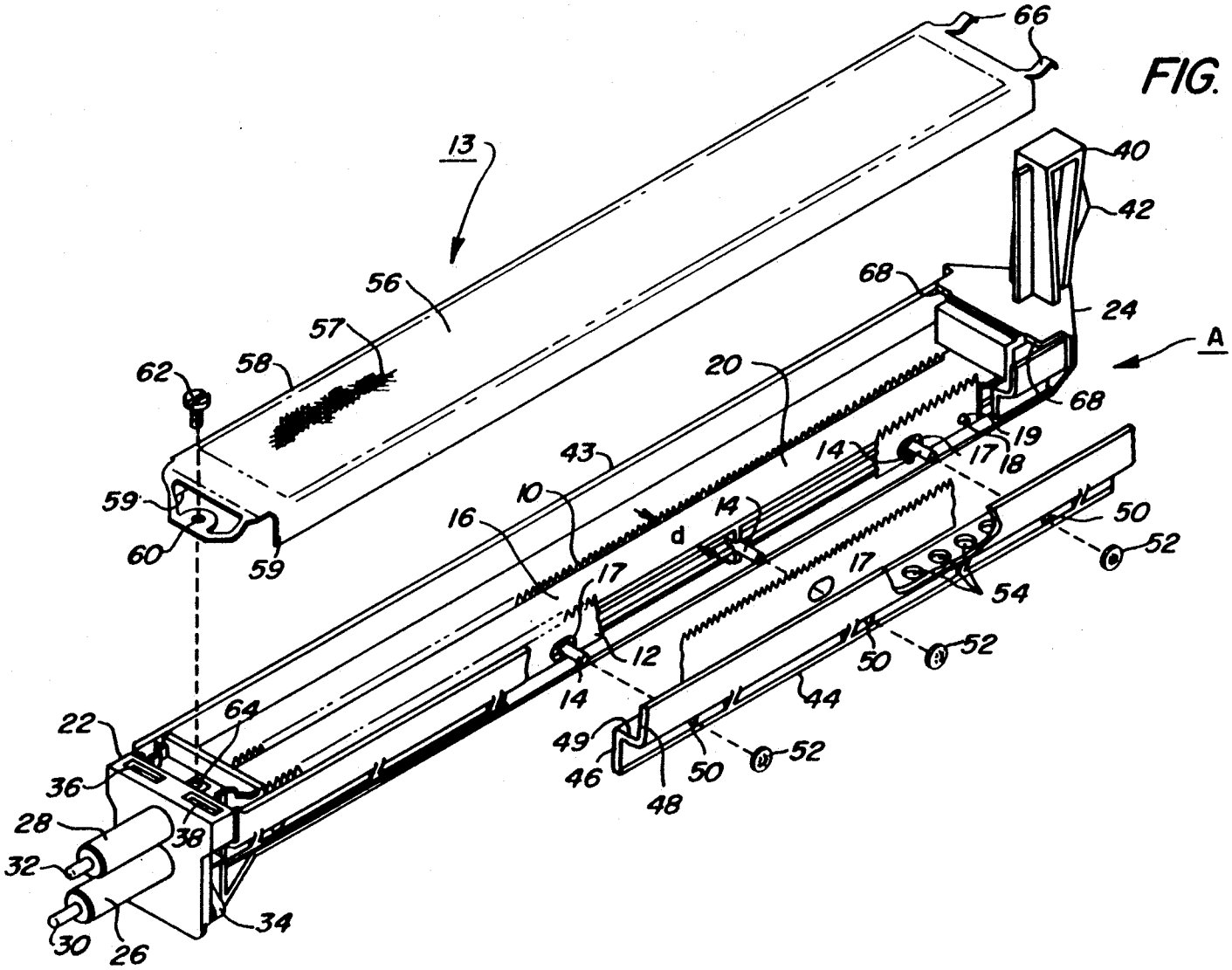
FIG. 1 is an isometric view of a preferred embodiment of a corona generating device according to the present invention.

Referring initially to FIG. 1, a corona generating device is shown, characterize by two saw tooth pin array corona generating electrodes 10 and 12, and a control screen or grid 13 disposed between the pin array electrodes 10, 12 and the surface to be charged (not shown). While the following description will focus on a discussion of plating a control screen or grid, it will be appreciated by those of skill in the art that the specific plating of the present invention can be implemented on other components of the corona generating device, as for example, the shield members described further herein, for achieving beneficial performance with respect to the parking deletion problem associated with corona generating devices.

The electrodes 10, 12 may be supported on support projections 14 and locator pin members 18, extending outwardly at generally corresponding positions on opposite sides of a central insulative support member 16. Central support member 16 maintains the electrode members 10 and 12 spaced a distance d apart. The distance d is chosen to be as large as possible, consistent with the need for a compact devic, as smaller d spacings require greater power level to drive the particular corona generating device a producing conditions.

Support projections 14 extend through electrode support openings 17, spaced along the pin array electrodes 10 and 12. Support openings 17 are slightly large than the support projections 14 to allow a loose fit for adjustment in placement of the electrode members with respect to the corona generating device. Support projections 14 and locator pin member 18 are provided on support member 16 to correctly position pin array electrode 10 with respect thereto, while another locator pin member (not shown) is located at a slightly offset position on the opposite side of central support member 16 to position the otherwise generally identical pin array electrode 12 in an offset position with respect to pin array electrode 10. The locator pin members extend through a locator pin opening 19 on each pin array electrode and tightly fitting over the locator pin member to firmly position the electrodes. The pin array electrodes 10, 12 of the present invention and the arrangement for supporting them with respect to the photoconductive surface are described in terms of a preferred embodiment only. The present invention has equal applicability, for example, to corona generating devices including single or multiple electrodes, thin bare wire electrodes, dielectric coated wire electrodes or discrete pins in an array. Likewise, other support arrangements for accommodating the support of the corona generating electrodes 10, 12 and the screen 13 with respect to the photoconductive surface or surface to be charged are contemplated for use with the present invention.

Central support member 16 is provided with an electrode support portion 20 and mounting block members 22 and 24 on either end thereof. Support projections 14 extend outwardly from electrode support portion 20, on either side thereof, in opposing directions. Mounting block 22 integrally supports contact support portions 26 and 28, each respectively supporting a high voltage contact member 30, for coupling the pin array electrodes 10 and 12 to a high voltage source (not shown), and a low voltage contact member 32 for coupling control screen 13 to a low voltage source (not shown). Mounting block 22 also includes a locking spring member 34 which engages with receiving members (not shown) extending through locking spring slots 36 and 38 for mounting the corona generating device in an assembly on an electrophotographic machine. Cooperatively, mounting block 24, located opposite mounting block 22, supports an extension member 40 for insertion into a receiving slot (not shown) used to mount the device into the electrophotographic machine and to correctly position the device with respect to the assembly. A locking member 42, suitable for engagement with a spring biased locking member (not shown) on the electrophotographic machine assembly, locks the device into position therein.

Side support members 43 and 44 are generally identical members, advantageously provided with a stepped cross section having first and second vertical portions 46 and 48 joined by a horizontal portion 49. First vertical portion 46 is provided with support projection receiving openings 50 corresponding to support projections 14. Pin array electrodes 10 and 12 are each supported by support projections 14, between central support member 16 and one of the side support members 43 and 44. The electrodes 10, 12, side support members 43, 44 and central support member 16 are fixed into position with fasteners 52, fastened over support projections 14, and against side support members 43 and 44, to hold the assembly together. Alternatively, the structure can be held together by hot staking the support projections or by other means for providing the same support integrity. One or both of side supports 43 and 44 may advantageously be provided with an opening or an array of openings 54 along horizontal portion 49 to aid in the removal of possibly damaging corona byproducts from the area between the corona generating electrodes and the surface to be charged. Openings 54 additionally serve to aid in the prevention of arcing from the electrodes along the surfaces of side supports 43 and 44 toward screen 13.

Control screen 13 typically comprises an elongated member having a generally U-shaped cross section. The member desirably has a cross-sectional thickness in the range of 0.002 to 0.0105 in, (0.051 to 0.267 mm.) with the limits determined primarily by either mechanical properties of strength or cost of materials. A planar portion 56 is comprised generally of a grid portion 57 having approximately a 40–70% open area, and a frame portion 58, surrounding grid portion 57 to form the periphery of planar portion 56. The upper limit of the grid open area is determined by mechanical properties of strength and desired current efficiency, while the lower grid open area limit is determined by the required efficiency in operation of the corona generating device. Parallel flange portions 59 extend perpendicularly from planar portion 57 along the elongated edges thereof, which will fit inside second vertical portion 48 on side support members 43 and 44 for maintaining screen 13 in position with respect to the corona generating electrodes 10, 12.

Screen 13 is supported at either end on mounting blocks 22 and 24. The screen 13 may advantageously be provided with a fastener receiving opening 60 disposed at one end of the screen 13 for receiving a conductive fastener member 62, inserted through an opening 64 in mounting block 22 to contact low voltage potential contact member 32. Spring tongue members 66, arranged at an end of the screen opposite to the fastener opening 60 are insertable into receiving openings 68 in mounting block member 24.

Figure 2:
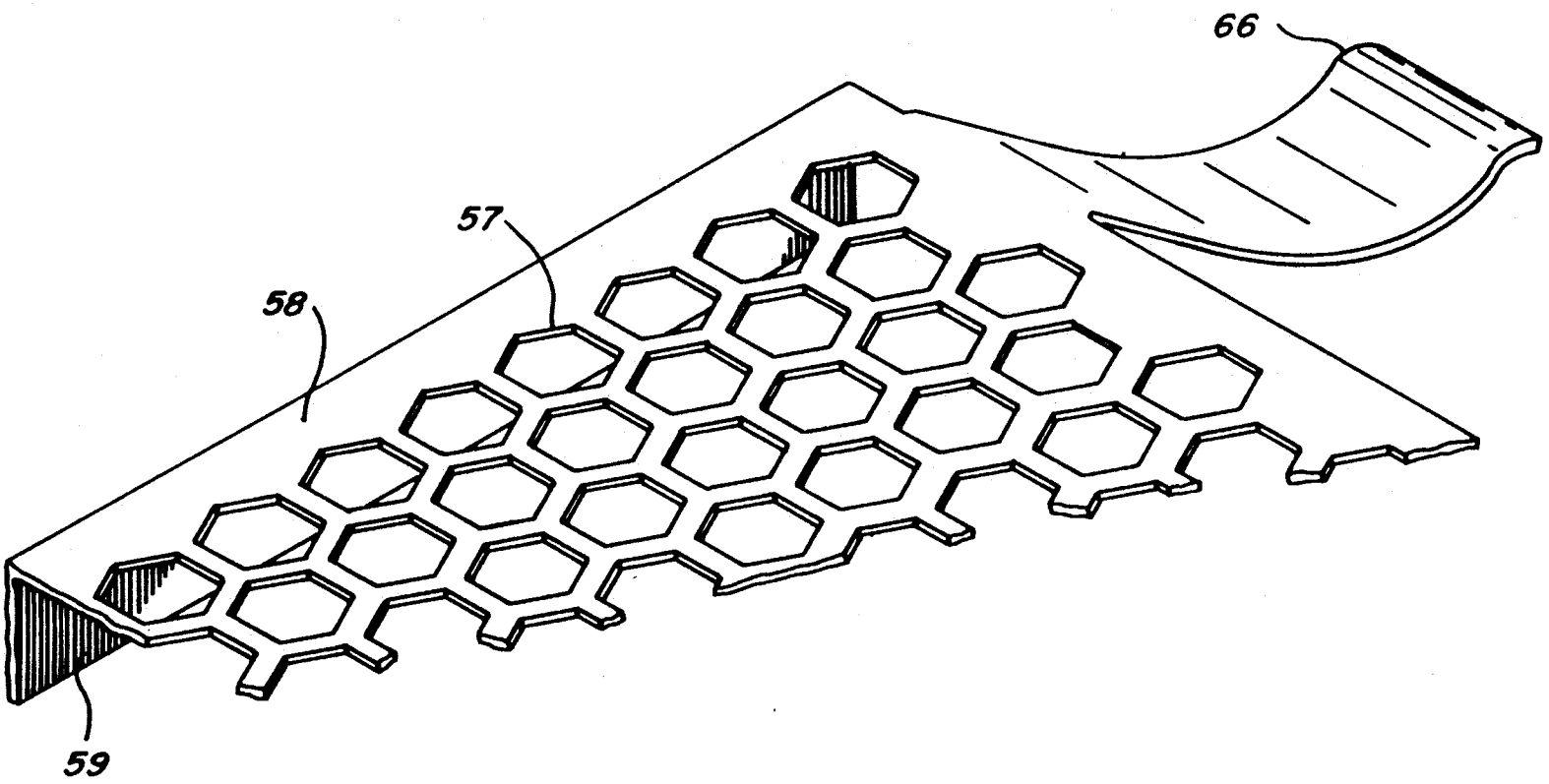
FIG. 2 is an enlarged view of the control grid used in the corona generating device illustrated in FIG. 1.

Referring to FIG. 2, grid portion 57 of the control screen 13 may advantageously be comprised of a closely spaced array of hexagonally shaped openings. This arrangement is preferred only for the purpose of ease of fabrication, strength of the grid portion, and efficiency in usage of space. Other arrangements and configurations could be used to the same end without effecting operational characteristics of the screen.

In order to fabricate the screen element 13, the shape is formed from a selected substrate material by a series of stamping steps which variously stamp the periphery of the screen and perforate the openings, including the grid openings. Subsequently, the screen is heated to a stress-relieving temperature to alleviate structural stresses caused by the perforation operation. Upon heating, some shrinkage of the material is noted. It has been noted that the shrinkage induces a tensioning force on the grid portion which acts to enhance and maintain flatness in the screen. Subsequent to heat treating, the flange portions 59 along the elongated edges of the screen may be formed, and the screen is coated with the coating material of the present invention.

Control screen 13 is attached to the corona generator by insertion of spring tongue members 66 into receiving openings 68, and inserting conductive fastener 62 through fastener receiving opening 60 on screen 13. Conductive fastener 62 is installed into opening 64 on mounting block 22 for electrical connection of the screen to the low voltage contact member 32. The corona generator is held in position within the reproduction machine at the mounting block portions, disposed so as to make the contact support portions available for a plug-type connection to a power source. For the purposes of charging the photoreceptor surface in a reproduction machine, a D.C. voltage of between −6.5 to −10 Kv is applied to the high voltage contact member, while a low D.C. voltage of −500 to −1500 v, or approximately the voltage level desired at the photoreceptor, is applied to the low voltage contact member.

It will be appreciated that the present invention is equally applicable to the use of control screens or grids formed of wire mesh arrangements, wherein a wire or wires of the defined material are arranged in a mesh-like pattern, positioned between the corona generating electrodes and the photoconductive surface. The wires may be supported on, for example, notchings in the side support members, and arranged in a pattern uniformly covering the area between the electrode and the photoconductive surface. The wire or wires forming the pattern must all be connected to the low voltage potential. Wire grid or screen corona generators are well known in the electrostatograpic arts, and their use may provide certain preferable advantages and improvements.

Referring once again to FIG. 2, the control screen 13 is coated with a substantially continuous plating material for neutralizing the nitrogen oxide species that may be generated when the corona generator is energized. Since the screen 13 is the closest element of the electrode assembly to the photoconductive surface, nitrogen oxide species at the screen 13 have a particularly deleterious effect. However, as previously noted, it will be appreciated by those of skill in the art that the continuous plating material of the present invention may be advantageously used to plate components of the corona generator other than only the screen 13.

In accordance with the present invention, control screen 13 is fabricated from various aluminum, steel, or other conductive base or substrate materials provided with a boron electroless nickel coating. Alternatively, the screen can be fabricated as a solid boron electroless nickel assembly. The use of the disclosed boron electroless nickel material appears to have the effect of substantially reducing the presence of nitrogen oxide species in the areas proximate to the corona generating electrodes, such as the screen, when compared to other materials previously used in the art, such as stainless steel or beryllium copper alloys.

In a preferred embodiment, the coating material comprises a boron electroless nickel with approximately 1.8% boron by weight. Other alloys of boron electroless nickel having different ranges of boron or nickel may be used with optimum results found with a boron content between 0.2% to 4%, by weight. While alloys of boron electroless nickel having higher percentages of boron may provide desirable anti-corrosion properties and anti-deletion properties, such alloys may also have a disadvantageous reduced conductivity. Additionally, alloys having a percentage of boron greater than about 4% can become prohibitively expensive and difficult to obtain in commercial quantities.

In the present invention, the plating is formed on the screen by an electroless plating process wherein the controlled autocatalytic deposition of a continuous film is accomplished by the interaction in solution of nickel with an organo-boron compound as the chemical reducing agent. The deposited nickel then functions as the catalyst and the process becomes self-sustaining or autocatalytic, provided that the nickel and reducing agent are replaced, to yield a boron containing alloy of nickel. The electrons used for reduction in the electroless plating process are supplied by a chemical reducing agent present in solution as opposed to being supplied by an external energy source such as a battery or generator, as in the case of electroplating. The detailed theory of the electroless process is well known in the art. Chemical reducing agents are much more expensive than electricity such that electroless plating costs more per weight of deposited metal than electrolytic plating. However, the electroless plating process yields the advantage of providing a uniform coating on any platable object such that specially shaped anodes, shields, or complex rack designs are not necessary, and even the most complex geometric shapes can receive a very uniform plated film. Further, a major advantage of the electroless solutions is their ability to give conductive metallic films on properly prepared non-conductors, such as platable grade plastics and platable paper. Thus, the present invention may be used to plate an insulative member such as insulative support member 16, for example.

Typically the metallic salt of nickel is present in the solution in an amount from about 0.5% to 1.3% by weight of the total weight of the solution. The organo-boron reducing agent is present in the solution in an amount of from about 0.1% to about 0.3% by weight of the total weight of the solution. In addition, small quantities up to about 10% by weight of the total weight of the solution of additives including a pH adjustor such as sodium hydroxide and a complexing agent such as ethylene diamine may be present in the solution to control stability of the chemical reaction. One of skill in the art will understand that other electroless processes using other buffering and complexing agents could be used to formulate a boron electroless nickel bath to provide the desired boron electroless nickel plating of the present invention.

The disclosed process provides a substantially continuous thin conductive film of boron electroless nickel on the surface to be coated. Typically, the film coating is formed on a preformed screen stamped from an aluminum or cold rolled steel substrate. Other substrate materials such as stainless steel, copper, bronze, and beryllium copper have also been plated and have been shown to provide adequate results in the corona environment.

The boron electroless nickel coating layer of a corona screen, as disclosed by the present invention, is applied in a thickness that will not be consumed in a reasonable period of time by the irreversible neutralization of the nitrogen oxide species. Typically, the electroless plating process is allowed to react to provide a film thickness between approximately 0.0005 to 0.001 inches (0.013 to 0.026 mm) as a substantially uniform continuous layer absent any pores or deletions therein. The film may be applied in a single layer or in multiple layers, as desired.

The exact mechanism by which the boron electroless nickel film provides long effective life in preventing parking deletion failures and limiting build-up of oxidation products is not completely understood. Tests were run on various substrates having a boron electroless nickel thin layer coating as prescribed by the present invention to determine the material having the most effective photoreceptor parking deletion and corrosion performance. These tests also took into consideration cost advantages that could result in significant dollar savings with respect to large quantity development of such screens for major programs. Other requirements such as serviceability, material selection, corrosion resistance, parking deletion resistance, manufacturability, and robustness of the final screen product with respect to standard shipping and packaging conditions were also considered.

EXAMPLE 1

A screen comprising an aluminum substrate was electroless plated to provide a coating of nickel boron, as described herein. The aluminum substrate was dipped into a solution of nickel boron for one hour. The nickel boron solution included a nickel density of 1.0% by weight of the solution and a boron density of approximately 0.2% by weight of the solution. The electroless plating process was allowed run for one hour to form a hard conductive thin film coating believed to contain by weight approximately 2.0% boron yielding a thickness of approximately 0.001 inches (0.026 mm). As a pre-treatment, in order to prevent corrosive attack on the aluminum screen by the strongly alkaline boron/nickel solution (pH 14), the screen was plated for 5 minutes in a diluted electroless boron nickel both formulated to operate at a pH of about 7 at a temperature of approximately 30° C. This screen was tested for one hundred hours, cycling 60 seconds on, 10 seconds off at 0.14 miliamp/inch and then allowed to outgas for 20 minutes with machine power on. Subsequently, a copy quality copy set was produced for comparison with the other various substrates comprising the nickel boron coating, yielding high quality copies.

EXAMPLE 2

A screen comprising a cold rolled steel substrate was plated to provide a coating of nickel boron, as described herein. The cold rolled steel substrate was electroless plated using a standardized electroless process wherein the cold rolled steel substrate was dipped in a solution at 200° C., for one hour to form a hard conductive coating of nickel boron which is believed to contain by weight, 2.0% boron. As a pre-treatment, the substrate was plated cathodic at one hundred ASF in standard woods nickel solution for one minute at room temperature. The boron electroless nickel coating of the cold rolled substrate showed test results of no parking deletions for up to 300 hours.

EXAMPLES 3,4,5

The procedure of Example 2 was repeated for an electrolytic tough pitch copper base substrate, a phosphorous bronze base substrate, and a beryllium copper base substrate, respectively. Test results showed parking deletions occurring at approximately 200 hours, 220 hours, and 190 hours, respectively.

In recapitulation, it is evident that the corona generator of the present invention comprises a component stamped in the form of a control screen including a boron electroless nickel plating thin film coating for reducing the effects of parking deletions and corrosion produced during the corona generating process. The boron electroless nickel coating provides a cost-effective material for meeting performance requirements in an electrostatographic processing machine. This coating material also yields a significant cost advantage that could result in a very significant dollar savings in large quantity production. In comparing the base materials, cold rolled steel plated by the material of the present invention offers significant cost advantages over other materials while yielding superior parking deletion abatement. Specifically, cold rolled steel having a boron electroless nickel coating did not cause a parking deletion until upwards of 300 hours. As such, the coating offers approximately a fourfold deletion improvement over a non-coated, cold rolled steel material and a 50% increase over the beryllium copper screens of the prior art while having potentially lower manufacturing costs.

While the invention has been described with reference to the specific embodiments it will be apparent to those skilled in the art that many alternatives, modifications and variations may be made. It is intended to embrace such modifications and alternatives as may fall within the spirit and scope of the appended claims.

We claim:

1. A corona generating device, comprising;

a support frame;

an electrode mounted on said support frame; and an element mounted on said support frame proximate to said electrode, said element including a substantially continuous layer of boron electroless nickel.

2. The corona generating device of claim 1, wherein said element includes a control screen for positioning adjacent said electrode.

3. The corona generating device of claim 2, wherein said layer of boron electroless nickel includes about 2% by weight boron.

4. The corona generating device of claim 1, wherein said layer has a minimum thickness of approximately 0.0005 inches.

5. The corona generating device of claim 1, wherein said electrode includes at least one linear pin array.

6. The corona generating device of claim 2, wherein said element includes a base substrate made from aluminum.

7. The corona generating device of claim 2, wherein said element includes a base substrate made from cold rolled steel.

8. The corona generating device of claim 2, wherein said element includes a base substrate made from copper.

9. The corona generating device of claim 2, wherein said element includes a base substrate made from phosphorous bronze.

10. The corona generating device of claim 1, wherein said element includes a base substrate mode of plating grade plastic.

11. The corona generating device of claim 1, wherein said element includes a base substrate of platable paper.

12. The corona generating device of claim 2, wherein said element includes a base substrate made from beryllium copper.

13. The corona generating device of claim 2, wherein said element includes a plurality of apertures therein.

14. An electrostatographic printing apparatus including a corona generating device for depositing a charge on an imaging surface, comprising:

a corona generating electrode;

a voltage source coupled to said electrode; and an element positioned proximate to said electrode, said element being coated with a substantially continuous layer of boron electroless nickel.

15. The electrostatographic printing apparatus of claim 14, wherein said element includes a control screen positioned between said electrode and the imaging surface.

16. The electrostatographic printing apparatus of claim 15, wherein said layer of boron electroless nickel includes about 2.0% by weight boron.

17. The electrostatographic printing apparatus of claim 15, wherein said layer has a minimum thickness of approximately 0.0005 inches.

18. The electrostatographic printing apparatus of claim 15, wherein said electrode includes at least one linear pin array.

19. The electrostatographic printing apparatus of claim 15, wherein said element includes a base substrate made from aluminum.

20. The electrostatographic printing apparatus of claim 15, wherein said element includes a base substrate made from cold rolled steel.

21. The electrostatographic printing apparatus of claim 15, wherein said element includes a base substrate made from copper.

22. The electrostatographic printing apparatus of claim 15, wherein said element includes a base substrate made from phosphorous bronze.

23. The corona generating device of claim 14, wherein said element includes a base substrate made from plating grade plastic.

24. The corona generating device of claim 14, wherein said element includes a base substrate made from platable paper.

25. The electrostatographic printing apparatus of claim 15, wherein said element includes a base substrate made from beryllium copper.

26. The electrostatographic printing apparatus of claim 15, wherein said element includes a plurality of apertures therein.

* * * * *